United States Patent [19]

Bunch, Jr.

[11] Patent Number: 4,547,184

[45] **Date of Patent: * Oct. 15, 1985**

[54] DELIVERY MECHANISM FOR PAPER SHEET PROCESSING APPARATUS

[75] Inventor: Earnest B. Bunch, Jr., Phoenix, Ariz.

[73] Assignee: B. Bunch Company, Inc., Phoenix, Ariz.

[ * ] Notice: The portion of the term of this patent subsequent to May 8, 2001 has been disclaimed.

[21] Appl. No.: 503,424

[22] Filed: Jun. 13, 1983

Related U.S. Application Data

[63] Continuation-in-part of Ser. No. 412,392, Aug. 30, 1982, abandoned.

[51] Int. Cl.[4] ..... B65H 45/20

[52] U.S. Cl. ..... 493/414; 493/410

[58] Field of Search ..... 493/409–415

[56] References Cited

U.S. PATENT DOCUMENTS 3,352,553 11/1967 Preston ..... 493/413
3,499,643 3/1970 Biggar, Jr. ..... 493/415
4,026,452 5/1977 Megen ..... 493/410
4,447,219 5/1984 Bunch, Jr. ..... 493/410

FOREIGN PATENT DOCUMENTS 2506901 8/1975 Fed. Rep. of Germany ..... 493/413

*Primary Examiner*—Daniel C. Crane
*Attorney, Agent, or Firm*—Drummond & Nissle

[57] ABSTRACT

A machine for folding continuous form stationery along transverse lines of weakening formed in the stationery. The machine includes a distribution mechanism for alternately dispensing lines of weakening in the stationery in opposite lateral directions of travel. Stationery distributed by the distribution mechanism is received between a pair of opposed endless belt units. The endless belt units fold stationery dispensed by the distribution mechanism and form a zig-zag stack of stationery between the belt units. The pair of opposed belt units contacts the outer parallel edges of the continuous form stationery and gradually carries the dispensed stationery away from the distribution mechanism.

3 Claims, 9 Drawing Figures

FIG-4
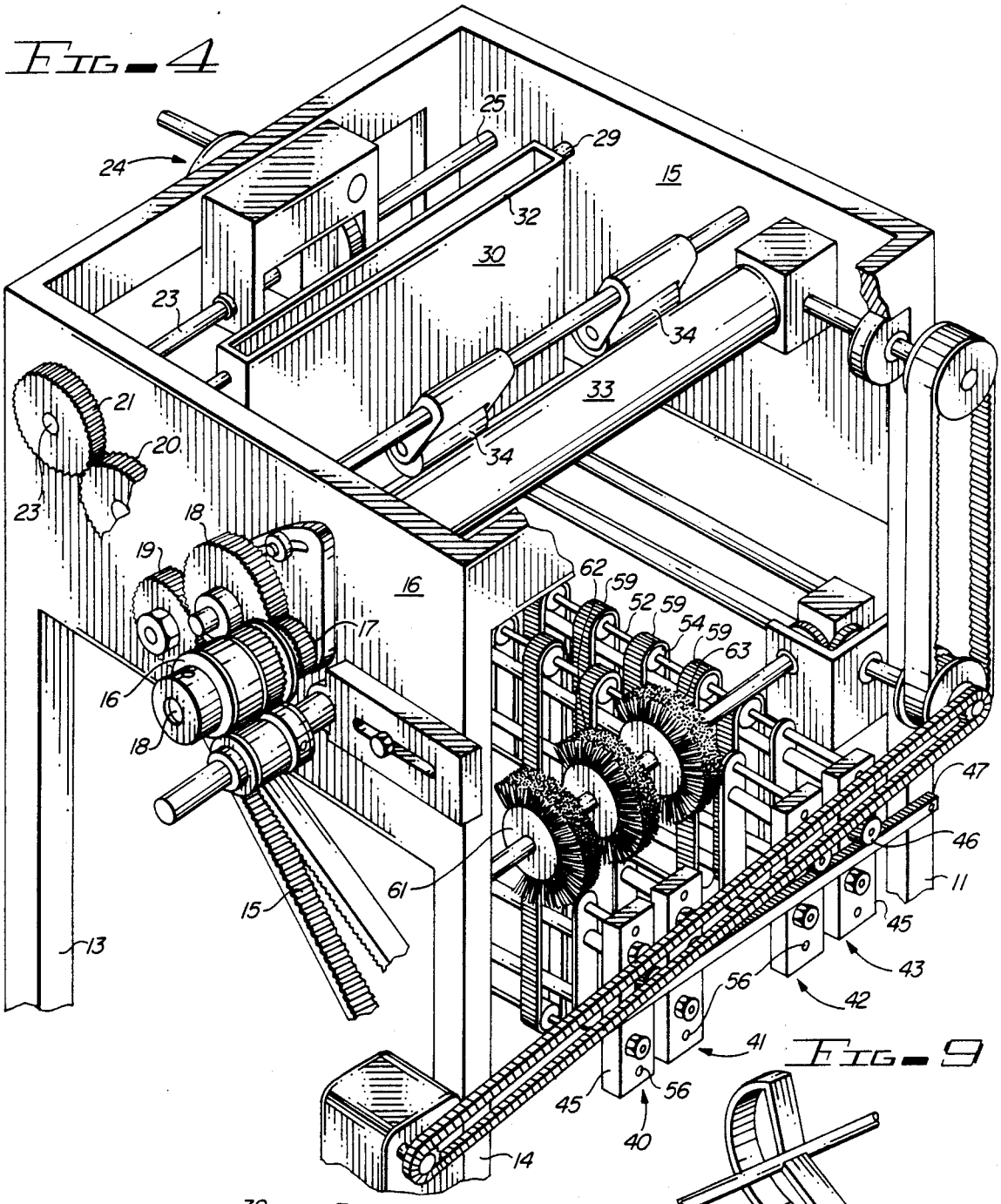
FIG-9
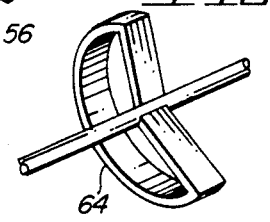
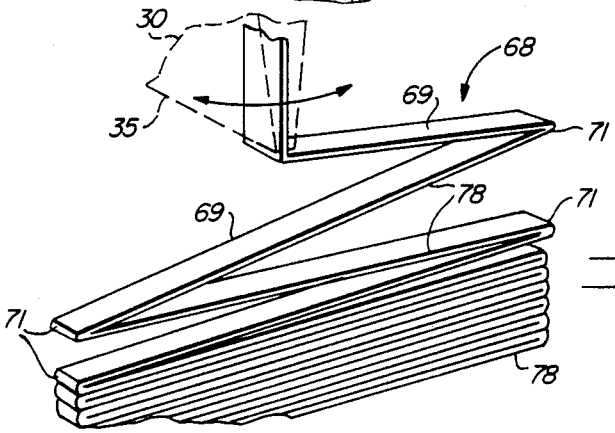
FIG-5

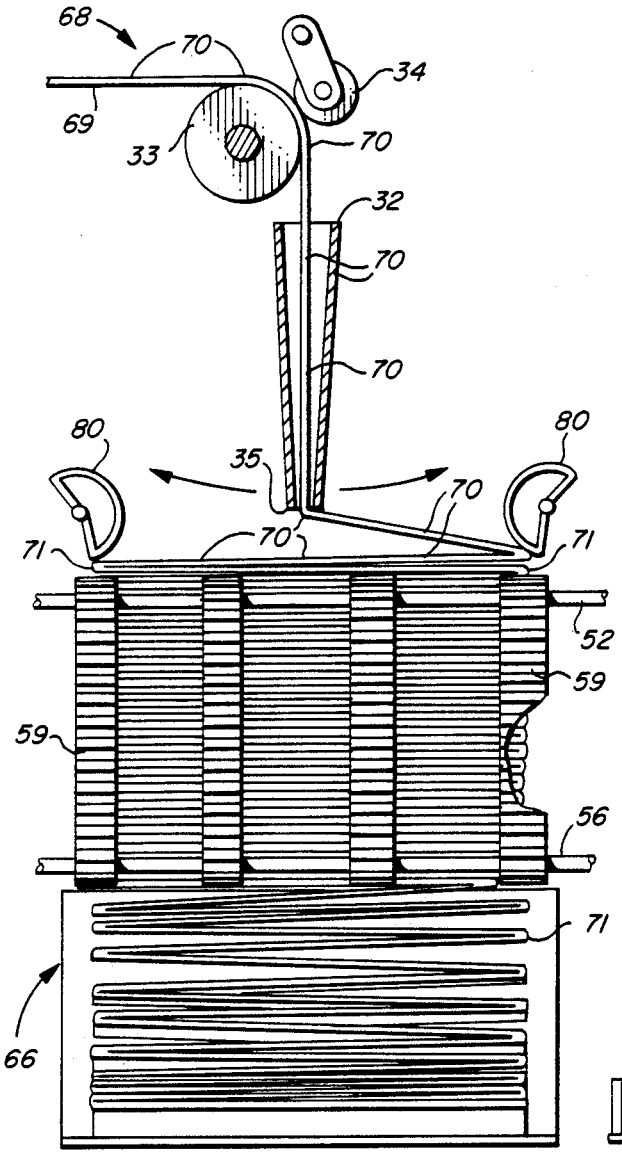
FIG. 6
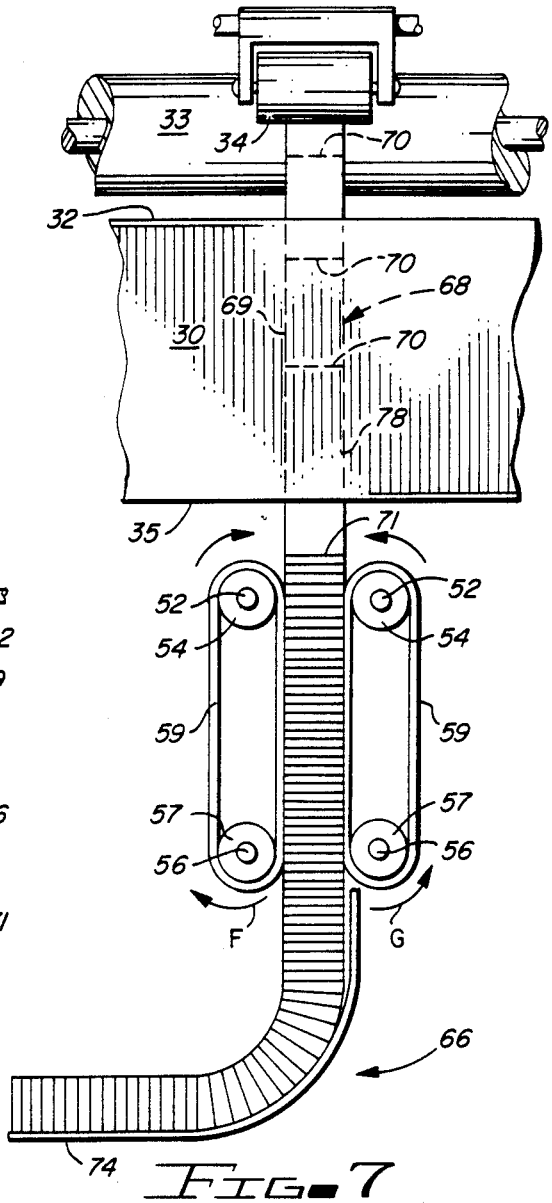
FIG. 7
FIG. 8
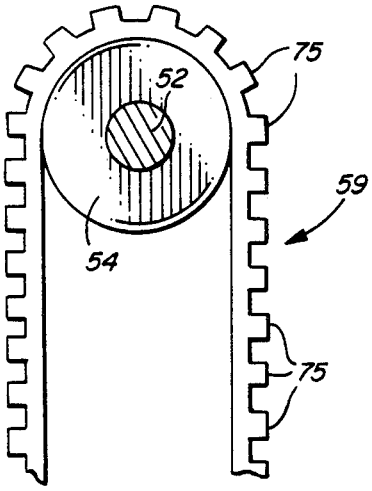

DELIVERY MECHANISM FOR PAPER SHEET PROCESSING APPARATUS

This comprises a continuation-in-part of my copending application Ser. No. 412,392, filed Aug. 30, 1982, now abandoned, for "DELIVERY MECHANISM FOR PAPER SHEET PROCESSING APPARATUS".

This invention relates to paper manufacturing apparatus.

More particularly, the invention relates to an improved stationery folding machine of the type having a mechanism which distributes successive lines of weakening formed in a strip of paper in substantially opposite directions, and having additional mechanisms for folding the paper along the lines of weakening to produce continuous form stationery.

Even more specifically, the invention relates to improved apparatus for transporting continuous form stationery produced by folding a strip of paper along transverse lines of weakening formed therealong, the improved paper transport apparatus facilitating the delivery of folded continuous form stationery to a packing station.

In another respect, the invention concerns an improved paper folding machine which can rapidly fold long, narrow strips of paper of the type utilized to form ticket rolls for movie theaters.

In a further and more specific respect, the invention concerns an improved paper folding machine of the general types disclosed in U.S. Pat. Nos. 2,098,427 to Menschner, 3,086,768 to Lach, 3,352,553 to Preston and 3,711,085 to Bunch, Jr.

The two general types of continuous form paper folding machines described in U.S. Pat. Nos. 2,098,427 to Menschner, 3,086,768 to Lach, 3,352,553 to Preston, and 3,711,085 to Bunch, Jr. have achieved fairly wide commercial acceptance in the market. These "continuous belt" and "oscillating chute" paper folding machines include a mechanism for distributing successive lines of weakening formed in a strip of paper in substantially opposite directions, rollers for continuously providing the dispensing mechanism with paper, and folding mechanisms for creasing paper dispensed by the distributing mechanism.

While the folders described in U.S. Pat. Nos. 3,352,553 to Preston, 3,711,085 to Bunch, Jr., 2,098,427 to Menschner, and 3,086,768 to Lach can effectively fold a wide variety of conventional business forms, these machines generally cannot effectively fold long, thin strips of paper of the type commonly utilized to form rolls of tickets for movie theaters. Consequently, long, thin strips of paper for movie theater tickets are currently wound on a spindle to form a paper roll. If, instead of being wound on a spindle, ticket paper could be successfully folded in zig-zag fashion in individual stacks, the paper could be fed from a folded stack through a printing machine or other apparatus. Printed paper from the machine would then travel directly into a storage box. Thus, the ability to pre-fold ticket paper in zig-zag fashion would facilitate storage of the paper and would eliminate having to produce spindles to carry and store the paper.

Another disadvantage of winding paper around spindles is that unrolling long strips of paper from a spindle to view a particular section of the paper can be time-consuming. If the section of paper to be viewed is near the spindle carrying the paper, the entire roll of paper must be unrolled. In contrast, when paper is folded in zig-zag fashion in individual stacks, each stack of paper can be rapidly thumbed through to locate the desired section of paper.

Accordingly, it would be highly desirable to provide an improved continuous form paper folding machine which could rapidly fold long, thin strips of paper of the type commonly found on movie theater ticket rolls.

Therefore, it is the principal object of the invention to provide an improved paper folding machine.

Another object of the instant invention is to provide improvements in the general types of paper folding machines described in U.S. Pat. Nos. 2,098,427 to Menschner, 3,086,768 to Lach, 3,352,553 to Preston and 3,711,085 to Bunch, Jr.

A further object of the invention is to provide an improved continuous form paper folding machine which can rapidly fold long, thin strips of paper of the type found on movie theater ticket rolls.

These and other, further and more specific objects and advantages of the invention will be apparent to those skilled in the art from the following detailed description thereof, taken in conjunction with the drawings, in which:

FIG. 4 is a rear perspective view of the continuous form paper folding machine of FIG. 1;

FIG. 5 is a partial perspective view further illustrating the chute and folded strip of paper of FIGS. 6 and 7;

FIG. 6 is a schematic representation of the interrelationship of the chute and delivery mechanisms of the continuous paper folding machine of FIG. 1;

FIG. 7 is a schematic side view of the paper folding and delivery components shown in FIG. 6;

FIG. 8 is an enlarged view of one of the belts of the rotary belt units of FIGS. 6 and 7; and, FIG. 9 is a perspective view of an alternate beater element which may be employed in the continuous form paper folding machine of FIGS. 1 and 4.

Briefly, in accordance with my invention, I provide an improved machine for producing continuous form stationery by folding a strip of paper along transverse lines of weakening formed therein, the strip of paper including a pair of generally opposed parallel outer edges and the transverse lines of weakening generally spanning the strip of paper between the outer edges. The machine includes a frame; means mounted on the frame for alternately distributing lines of weakening in the paper in substantially opposite directions; feed means carried on the frame for directing the continuous strip of paper into the distribution means; and, a support surface for receiving paper dispensed by the distribution means and subsequently folded. The improvement in the machine comprises delivery means including first endless belt means including at least one endless belt having an outer peripheral surface provided with outwardly projecting feet means spaced therealong; and, second endless belt means spaced apart from and generally opposed to the first endless belt means. The second endless belt means includes at least one endless belt having an outer peripheral surface provided with upstanding feet means spaced therealong. The first and second endless belt means are positioned on the frame to receive paper distributed by and to cooperate with the distribution means to fold the paper along the lines of weakening to produce a zig-zag stack of paper having a plurality of creased edges. The upstanding feet means formed on the first and second endless belt means provide support for the outer edges of the paper and impede the outer edges from downwardly sliding between the first and second endless belt means. The endless belts of the first and second endless belt means move such that paper dispensed by the distribution means is carried away from the distribution means.

Figure 1:
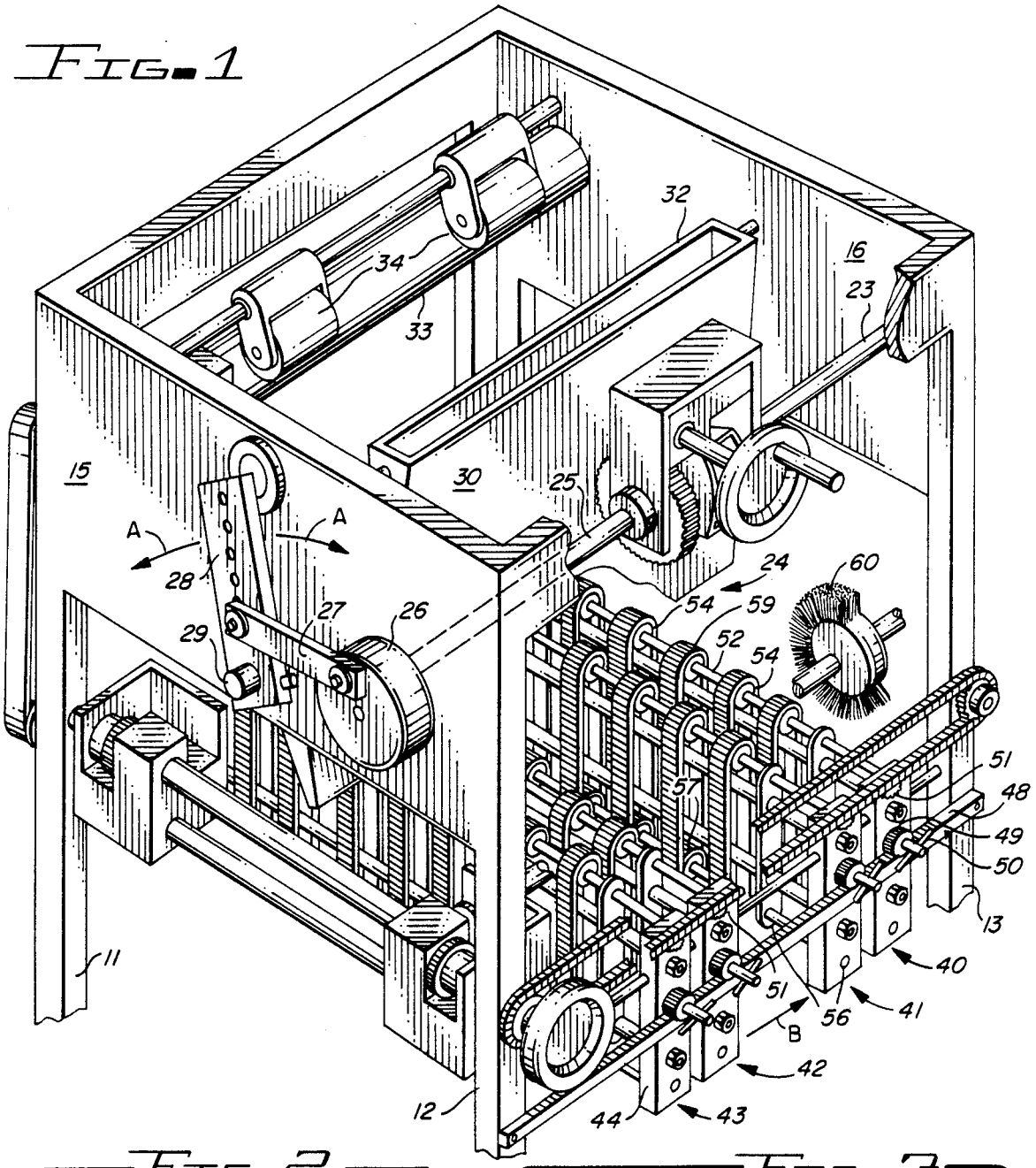
FIG. 1 is a perspective view of a continuous form paper folding machine constructed in accordance with the principles of the invention.
Figure 2:
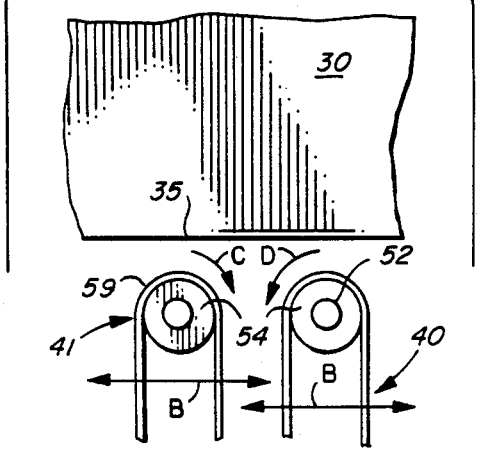
FIG. 2 is a schematic front view of a portion of the continuous form paper folding machine of FIG. 1 illustrating the mode of operation of the chute and delivery mechanism thereof.
Figure 3:
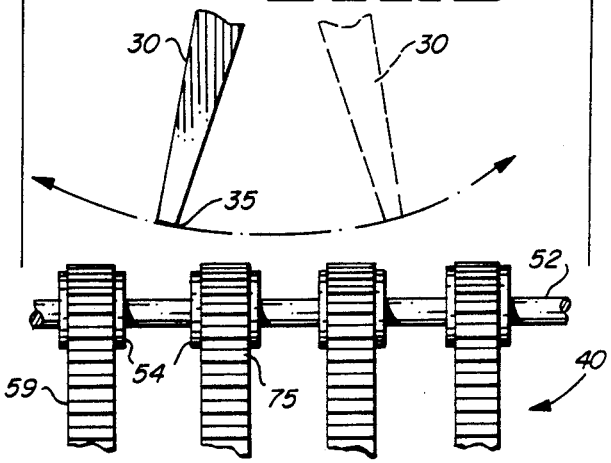
FIG. 3 is a schematic side view of a portion of the continuous form paper folding machine of FIG. 1 further illustrating the mode of operation and interrelationship of the chute and delivery mechanism thereof.

Turning now to the drawings, which depict the presently preferred embodiments and best mode of the invention for the purpose of illustrating the practice thereof and not by way of limitation of the scope of the invention, and in which like reference characters refer to corresponding elements throughout the several views, FIGS. 1 and 4 illustrate a paper folding machine constructed in accordance with the principles of the invention and having a frame including vertical legs 11–14 and walls 15, 16. Motive power is supplied to the paper folding machine through continuous belt 15 (FIG. 4). Belt 15 turns gears 16, 17 fixedly attached to shaft 18. Shaft 18 is rotatably journaled in wall 16. Motive power from gear 17 is transmitted through interconnected rotary gears 18–21. Gear 21 is fixedly attached to and turns rod 23. Motive power from rotating rod 23 is transmitted into and through differential unit 24 to rod 25. Differential unit 24 permits the rate of rotation of shaft 25 to be retarded or advanced in relation to the rotation of shaft 23. Shaft 25 is fixedly attached to and turns centric 26. One end of rectangular rod 27 is pivotally attached to centric 26 and the other end of rod 27 pivotally attached to elongate rectangular member 28. Member 28 is fixedly secured to rod 29. Rod 29 is rotatably journaled in wall 15 and fixedly attached to one side of chute 30. The other side of chute 30 is fixedly attached to shaft 31 rotatably journaled in wall 16. Thus, when shaft 25 rotates centric 26, arm 28 oscillates back and forth as indicated by arrows A, causing chute 30 to oscillate back and forth. Paper is fed into upper mouth 32 of chute 30 by roller 33. Pressure rollers 34 secure the paper against primary roller 33.

Chute 30 oscillates through an arc by moving in a first direction of travel to one end of the arc, momentarily stopping at the end of the arc, moving in a second direction opposite the first direction of travel through the arc to the other end of the arc, momentarily stopping at the other end of the arc, and by then continuously repeating the sequence of movements just described. As would be appreciated by those of skill in the art, the rate of oscillation of chute 30, the arc through which chute 30 travels, and the rate at which roller 30 feeds paper into chute 30 can be altered as desired by adjusting the gearing of the machine or the rate of travel of belt 15. The rate of travel and arc of oscillation of chute 30 in relation to the speed of feed roller 33 are adjusted so that lines of weakening are generally dispensed from lower mouth 35 of chute 30 when chute 30 has momentarily stopped at one end of its arc of oscillation.

Paper dispensed from mouth 35 of chute 30 is downwardly tamped at each creased end by at least one of beaters 60–63 and is received between one of rotary belt unit pairs 40–41, 42–43. Each belt unit 40–43 includes at one end thereof an upright elongate rectangular member 44 slidably carried on rod 46 fixedly attached at its ends to legs 12, 13. A similar upright elongate rectangular member 45 is at the other end of each rotary belt unit 40–43. Each member 45 includes a sprocket 46 which is rotatably carried thereon and engages and moves along toothed track 47 spanning the space between legs 11, 14. Each member 44 includes a sprocket 49 rotatably mounted thereon. Sprockets 49 engage and move along toothed track 48 spanning the space between legs 12, 13. The position of each of units 40–43 in relation to and along tracks 47, 48 is adjusted by turning T-shaped handhold 50 carried on rectangular member 44. When T-shaped handhold 50 of one of units 40–43 is turned, the unit moves along tracks 47, 48 in one of the directions indicated by arrows B in FIG. 1. As will become apparent, the space between each opposed belt pair 40–41, 42–43 is adjustable so the apparatus of FIGS. 1–9 may be appropriately adjusted and utilized to fold paper strips of differing width. In FIG. 1 the space between opposed belt units 40, 41 has been adjusted to receive elongate strips of paper having only a minimal width; for instance, paper strips of the type utilized on rolls of tickets for movie theaters. The apparatus of FIGS. 1–9 can, in addition to being used to fold narrow strips of paper, be utilized to fold wider strips of paper normally folded on conventional "belt" and "spiral" paper folding machines.

Each rotary belt unit 40–43 also includes an upper elongate rod 52 which spans the space between and is, at its ends, rotatably journaled in rectangular members 44, 45. The end of rod 52 rotatably journaled in member 44 passes therethrough and fixedly carries sprocket 51. A plurality of pulley wheels 54 are spaced along and fixedly secured to shaft 52. Lower elongate rod 56 of each unit 40–43 spans the space between members 44, 45 and is fixedly connected at its ends to members 44, 45. A plurality of pulley wheels 57 are spaced along and rotatably mounted on rod 56. Each vertically oriented belt 59 of units 40–43 passes around and is carried by an upper pulley wheel 54 and a lower pulley wheel 57. A chain (not shown for sake of clarity) engages and rotates sprockets 51, and therefore rods 52 and belts 59, at an appropriate rate in relation to the rate at which paper is dispensed from mouth 35 of chute 30. Sprockets 51 are rotated by the chain such that in each opposed belt pair 40–41, 42–43 the upper sprockets 54 carried along the left hand elongate rod rotate in a clockwise direction and the upper sprockets 54 carried on the opposing generally parallel right hand elongate rod 52 rotate in a counterclockwise direction. For example, in FIG. 2 sprockets 54 on opposed rods 52 rotate in the directions indicated by arrows C, D. As a result, in each opposed belt pair 40–41, 42–43 the sprockets 57 carried on the left hand lower elongate rod 56 rotate in a clockwise direction and the sprockets 57 carried on the opposing generally parallel right hand elongate rod rotate in a counterclockwise direction. For example, in FIG. 6 sprockets 57 on opposed rods 56 rotate in the directions indicated by arrow F, G. The afore-described rotation of upper and lower sprockets 54, 56 causes paper dispensed through mouth 35 of chute 30 to be received between and drawn downwardly away from chute 30 by belts 59.

The apparatus of FIGS. 1 and 4 is provided with two rotary belt units 40–41, 42–43 so that two separate strips of paper can be simultaneously fed through chute 30. One strip of paper would be received by and carried downwardly away from chute 30 by rotary belt unit 40–41 while the second strip of paper would be received by and carried downwardly away from chute 30 by rotary belt unit 42–43.

In FIGS. 1 and 4 beaters 60–63 are positioned as desired to engage the creased edges of paper dispensed by chute 30 and to aid in downwardly displacing the dispensed paper toward and between rotary belt unit 40–41 or 42–43 receiving paper from chute 30. Brush beaters 60–63 could be replaced by half-moon shaped beaters 64 of the type pictured in FIG. 9 or by any other appropriately shaped, contoured and dimensioned beater. The gearing of the machine and, if necessary, rate of supply of motive power to the apparatus are adjusted so beaters 60–63 rotate at a rate commensurate and synchronized with the rate at which paper is dispensed from chute 30.

The mode of operation of the presently preferred embodiment and best mode of the invention is further illustrated in FIGS. 5 and 6 where an elongate strip of paper 68 of the type utilized on movie theater ticket rolls is directed into upper mouth 32 of chute 30 by feed roller 33. Strip 68 includes elongate parallel outer edges 69, 78. Paper dispensed by oscillating chute 30 is received between and downwardly displaced by opposed belts 59 of units 40, 41. Beaters 80 assist in the creasing and downward displacement of paper distributed by chute 30. Folded paper carried away from chute 30 by rotary belt units 40, 41 is delivered to curved table 66. Folded zig-zag strip 68 slides down table 66 to the lower horizontal portion 74 thereof where the folded strip can be packed in storage boxes or transported to other processing equipment.

Certain of the transverse lines of weakening formed in strip 68 are indicated by the points identified by reference character 70 in FIG. 6. Reference character 71 identifies creased edges formed in strip 68 when strip 68 is folded along a line of weakening 70. In FIG. 5 strip 68 is not being folded at each successive line of weakening formed in strip 68 but is instead being creased along every fourth line of weakening formed therein. If desired, the apparatus of FIGS. 6 and 7 could be adjusted such that strip 68 was folded along each line of weakening formed therein, along every second line of weakening, every third line of weakening, every fifth line of weakening, etc.

In the practice of the invention distribution means other than chute 30 can be utilized to alternately distribute selected transverse lines of weakening in a strip of paper in substantially opposite directions. For instance, the opposed pair of endless belt distribution units shown in my U.S. Pat. No. 4,380,448 to Bunch could be used in place of chute 30 to alternately distribute selected transverse lines of weakening in a strip of paper in substantially opposite directions. The endless belt distribution units of U.S. Pat. No. 4,380,448 are generally identified by reference characters 20, 21 in FIG. 3 thereof.

Although the apparatus of FIGS. 1, 4, 6, 7 is designed to dispense a paper strip downwardly into a rotary belt unit, apparatus could be constructed in accordance with the principles of the invention in which lines of weakening in a continuous sheet of paper were dispensed by distribution means laterally or upwardly into a rotary belt unit like unit 40–41. The rotary belt unit would be constructed to receive paper dispensed by the distribution means and carry the paper away therefrom to a processing station.

The spaced, outwardly projecting, upstanding, horizontally disposed elongate feet 75 on endless belts 59 provide support for the elongate generally parallel opposed outer edges 69, 78 of paper strip 68 and help prevent the paper from downwardly sliding between vertically disposed endless belt units 40–41, 42–43. As would be appreciated by those of skill in the art, a series of horizontally disposed raised dots or a horizontal row of vertically oriented upstanding feet could, along with a variety of other upstanding, outwardly projecting elements, be formed on the outer peripheral surface of belts 59 to contact and provide support for the outer parallel edges of strip 68 and to impede folded paper from sliding downwardly between vertically disposed endless belt unit pairs 40–41, 42–43. See FIGS. 9A–9C of my copending application for "DELIVERY MECHANISM FOR PAPER SHEET PROCESSING APPARATUS", Ser. No. 474,186, filed Mar. 10, 1983, now U.S. Pat. No. 4,447,219.

As shown in FIG. 7, belts 59 in vertically disposed units 40 are generally parallelably opposed to belts 59 in unit 41. The horizontal distance or span between belts 59 in unit 40 and belts 59 in unit 41 is approximately equal to the width of the strip of paper being folded, i.e., to the shortest distance between the elongate, parallelably opposed outer edges 69, 78 of strip 68. If desired, units 40, 41 may be rotated toward one another so the distance between belts 59 in unit 40 and belts 59 in unit 41 is less near the bottom of units 40, 41 than at the top portion of units 40, 41, or, vice-versa. FIG. 8 of my copending application for "DELIVERY MECHANISM FOR PAPER SHEET PROCESSING APPARATUS", Ser. No. 474,186, filed Mar. 10, 1983, illustrates the manner in which the top portions of units 40, 41 could be rotated away from one another. In FIG. 8 of my copending application, the upper portions of belt units 55, 56 are further apart from one another than are the lower portions thereof.

FIG. 5 herein further illustrates the chute and folded paper of FIGS. 6 and 7 and FIG. 8 is an enlarged view of one of belts 59 of units 40, 41.

Having described my invention in such terms as to enable those skilled in the art to which it pertains to understand and practice it, and having described the presently preferred embodiments thereof, I claim:

1. In combination with apparatus for producing continuous form stationery by folding a strip of paper along transverse lines of weakening formed therein, said strip of paper including a pair of generally opposed parallel outer edges, said transverse lines of weakening generally spanning said strip of paper between said outer edges and having a length generally equivalent to the shortest distance between said outer edges of said paper strip, said apparatus including a frame, distribution means mounted on said frame for alternately dispensing transverse lines of weakening in said paper in substantially opposite directions, and feed means carried on said frame for directing said continuous strip of paper into said distribution means, delivery means for receiving paper dispensed by said primary distribution means, said delivery means including (a) first endless belt means including at least one moving endless belt having an outer peripheral surface including outwardly projecting feet connected to and spaced therealong; and (b) second endless belt means spaced apart from and in generally opposed, parallel relation to said first endless belt means by a distance generally equivalent to said length of each transverse line of weakening, said second endless belt means including at least one moving endless belt having an outer peripheral surface including outwardly projecting feet connected to and spaced therealong, said first and second endless belt means being positioned on said frame and operatively associated with said distribution means (c) to receive therebetween paper dispensed by said distribution means and carry said dispensed paper away from said distribution means;

(d) to cooperate with said distribution means to fold said dispensed paper along selected ones of said lines of weakening to produce a zig-zag stack of paper having a plurality of creased edges between and generally spanning the distance between said first and second endless belt means, said stack having a top portion and a bottom portion, each of said opposed parallel outer edges of said strip of paper in said folded zig-zag stack thereof generally contacting said outer peripheral surface of at least one of said endless belts carried by said first and second endless belt means;

(e) such that paper dispensed by said distribution means generally initially moves (i) between said first and second endless belt means and contacts said top portion of said stack of paper, and (ii) in a general direction of travel away from said distribution means, while being distributed on said top portion of said zig-zag stack of paper to form said creased edges and contact each of said opposed outer edges with at least one of said endless belts of said first and second endless belt means, said movement of said dispensed paper between said first and second endless belt means controlling the movement of said paper and facilitating the folding of paper by said apparatus, said feet being shaped, contoured and dimensioned to maintain each of said generally opposed outer edges of said zig-zag stack of paper contacting said outer peripheral surface of one of said endless belts of said first and second endless belt means in a generally fixed position with respect to said outer peripheral surface of said endless belt.

2. The apparatus of claim 1 wherein said distribution means comprises an oscillating chute.

3. The apparatus of claim 1 wherein (a) said distribution means comprises primary endless belt means mounted on said frame, said primary belt means including (i) a pair of spaced adjacent parallelably disposed paper distribution rollers, each of said rollers having a generally constant diameter along the length thereof, and a longitudinal axis about which said rollers rotate, and (ii) belts trained around said distribution rollers to form laterally extending conveyor runs with the belts and rollers cooperatively forming a passage between the distribution rollers to allow the paper strip to be fed through the passage, said belts having two runs which move in opposite directions to propel said paper strip in said opposite lateral directions; and, (b) said feed means directs said continuous strip of paper into said passage and into contact with at least some of said belts for said lateral distribution in said substantially opposite directions, said lateral distribution directions being generally perpendicular to said longitudinal axes of said distribution rollers.

* * * * *